US010654078B2

(12) United States Patent
Riddle et al.

(10) Patent No.: US 10,654,078 B2
(45) Date of Patent: May 19, 2020

(54) METHOD OF REMOVING AN UNWANTED CONSTITUENT FROM A SURFACE, A METHOD OF DETERMINING THE CLEANLINESS OF A HARD SURFACE, AND A MULTI-FUNCTIONAL COMPOSITION THAT INCLUDES HYDROPHILIC SILANE

(71) Applicant: 3M INNOVATIVE PROPERTIES COMPANY, St. Paul, MN (US)

(72) Inventors: Justin A. Riddle, St. Paul, MN (US); Terry R. Hobbs, St. Paul, MN (US); David D. Lu, Austin, TX (US); Andrew S. D'Souza, Shoreview, MN (US); Naiyong Jing, Woodbury, MN (US); James P. Gardner, Jr., Stillwater, MN (US); Yifan Zang, Coon Rapids, MN (US); Zachary J. Malmberg, Woodbury, MN (US); Milind B Sabade, Woodbury, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 69 days.

(21) Appl. No.: 15/862,706

(22) Filed: Jan. 5, 2018

(65) Prior Publication Data

US 2018/0126426 A1 May 10, 2018

Related U.S. Application Data

(62) Division of application No. 14/014,872, filed on Aug. 30, 2013, now Pat. No. 9,895,722.

(60) Provisional application No. 61/696,005, filed on Aug. 31, 2012.

(51) Int. Cl.

| | |
|---|---|
| ***C11D 3/00*** | (2006.01) |
| ***B08B 3/10*** | (2006.01) |
| ***C11D 3/16*** | (2006.01) |
| ***C11D 3/08*** | (2006.01) |
| ***C11D 3/12*** | (2006.01) |
| ***C11D 11/00*** | (2006.01) |

(52) U.S. Cl.
CPC ..... *B08B 3/10* (2013.01); *C11D 3/08* (2013.01); *C11D 3/1246* (2013.01); *C11D 3/162* (2013.01); *C11D 11/0035* (2013.01)

(58) Field of Classification Search
CPC ..... C09D 1/00; C09D 11/0035; C09D 3/162
USPC ..... 428/447; 510/180, 466
See application file for complete search history.

(56) References Cited

U.S. PATENT DOCUMENTS

| | | | | |
|---|---|---|---|---|
| 4,005,024 | A | 1/1977 | Rodriguez | |
| 4,005,025 | A | 1/1977 | Kinstedt | |
| 4,005,030 | A | 1/1977 | Heckert | |
| 4,005,119 | A | 1/1977 | Heckert | |
| 4,152,165 | A | 5/1979 | Langager | |
| 4,216,125 | A | 8/1980 | Campbell | |
| 4,243,545 | A | 1/1981 | Campbell | |
| 4,338,377 | A | 7/1982 | Beck | |
| 4,446,035 | A | 5/1984 | Barrat | |
| 4,548,954 | A | 10/1985 | Smith | |
| 4,591,652 | A | 5/1986 | DePasquale | |
| 4,859,359 | A | 8/1989 | DeMatteo | |
| 4,879,051 | A | 11/1989 | Lo | |
| 4,948,531 | A | 8/1990 | Fuggini | |
| 4,959,105 | A | 9/1990 | Neidiffer | |
| 5,073,195 | A | 12/1991 | Cuthbert | |
| 5,096,864 | A | 3/1992 | Yeckley | |
| 5,714,453 | A | 2/1998 | Neumiller | |
| 5,726,139 | A | 3/1998 | Willey | |
| 5,936,703 | A | 8/1999 | Miyazaki | |
| 5,964,934 | A | 10/1999 | Englert | |
| 6,040,053 | A | 3/2000 | Scholz | |
| 6,657,001 | B1 | 12/2003 | Anderson | |
| 6,740,626 | B2 | 5/2004 | Neumiller | |
| 7,455,912 | B2 | 11/2008 | Walters | |
| 7,985,798 | B2 | 6/2011 | Danzebrink | |
| 8,021,449 | B2 | 9/2011 | Seth | |
| 8,088,724 | B2 | 1/2012 | Iverson | |
| 8,143,206 | B2 | 3/2012 | Klinkhammer | |
| 9,340,683 | B2 * | 5/2016 | Jing | C09D 1/00 |
| 9,895,722 | B2 * | 2/2018 | Riddle | C11D 3/08 |
| 10,160,868 | B2 * | 12/2018 | Jing | C09D 1/00 |
| 2003/0109395 | A1 | 6/2003 | Neumiller | |
| 2004/0120915 | A1 | 6/2004 | Yang | |
| 2004/0194800 | A1 | 10/2004 | Chang | |
| 2004/0237833 | A1 | 12/2004 | Sepeur | |
| 2005/0154112 | A1 | 7/2005 | Shigeru et al. | |
| 2007/0299177 | A1 | 12/2007 | Serobian | |
| 2008/0066788 | A1 | 3/2008 | Riou | |
| 2010/0006006 | A1 | 1/2010 | Bohlander | |
| 2011/0033694 | A1 | 2/2011 | Jing | |
| 2012/0190607 | A1 | 7/2012 | Olson et al. | |
| 2013/0164730 | A1 * | 6/2013 | Gustafson | B43L 1/002 434/408 |
| 2018/0022146 | A1 * | 1/2018 | Gustafson | B43L 1/002 434/408 |

FOREIGN PATENT DOCUMENTS

| | | |
|---|---|---|
| EP | 0075998 | 4/1983 |
| EP | 0257514 | 3/1988 |
| EP | 1 116 813 | 7/2001 |
| JP | 1985-206900 | 10/1985 |
| JP | 1988-061094 | 3/1988 |
| JP | 1998-060483 | 3/1998 |

(Continued)

OTHER PUBLICATIONS

Glass Cleaners, CSPA Designation DCC-09, May 1983 (Re-approved in 2003), CSPA Cleaning Products Division Test Methods Compendium—Fourth Edition, 2 pages.

(Continued)

*Primary Examiner* — Gregory E Webb
(74) *Attorney, Agent, or Firm* — Daniel J. Iden

(57) ABSTRACT

A method of removing an unwanted constituent from a siliceous surface in which the method includes contacting the siliceous surface and the unwanted constituent with a multi-functional composition that includes water, a hydrophilic silane, and a surfactant, and drying the surface.

14 Claims, No Drawings

(56) References Cited

FOREIGN PATENT DOCUMENTS

| | | | |
|---|---|---|---|
| JP | 2003-095888 | | 4/2003 |
| JP | 2008-184511 | | 8/2008 |
| JP | 2008-239949 | | 10/2008 |
| JP | 2010-511763 | | 4/2010 |
| WO | WO 2001/081515 | | 11/2001 |
| WO | WO 2011/084661 | A3 | 7/2011 |
| WO | WO 2011/087104 | A1 | 7/2011 |
| WO | WO 2011/163175 | A1 | 12/2011 |
| WO | WO 2013/045277 | | 4/2013 |
| WO | WO 2013/064358 | | 5/2013 |

OTHER PUBLICATIONS

International Search Report for PCT/US2013/057591, prepared by the Korean Intellectual Property Office, dated Oct. 29, 2013.
EP International Search Report, Application No. EP13833936.1, dated Jun. 5, 2016 (7 pages).
P&G, Bold Granular Laundry Detergent MSDS Apr. 2, 2002, FH/H/2002/SCRS-58TFZW, 6 pages.
SDA, "Soaps and Detergent", 2nd edition, 1994, 19 pages.

* cited by examiner

METHOD OF REMOVING AN UNWANTED CONSTITUENT FROM A SURFACE, A METHOD OF DETERMINING THE CLEANLINESS OF A HARD SURFACE, AND A MULTI-FUNCTIONAL COMPOSITION THAT INCLUDES HYDROPHILIC SILANE

CROSS REFERENCE TO RELATED APPLICATIONS

This application is a divisional of U.S. application Ser. No. 14/014,872, filed Aug. 30, 2013, now allowed, which claims priority from U.S. Provisional Application Ser. No. 61/696,005, filed Aug. 31, 2012, the disclosure of which is incorporated by reference in its entirety herein.

BACKGROUND

The invention is directed to removing unwanted constituents from a siliceous surface and determining the cleanliness of a siliceous surface.

Conventional window cleaning compositions are typically designed to leave no visible residue on a glass surface when used to clean the glass surface. In other words, the glass surface should be free from a film and streaking. To achieve these properties, the level of surfactant and other additives in the cleaning composition must be low.

Organic solvents are often present in conventional window cleaning compositions to enable the composition to remove common stains and oily contaminants from glass surfaces.

Some window cleaning compositions include hydrophilic polymers or long chain alkyl sulfate surfactants, which are alleged to impart water-sheeting and anti-spotting properties to a surface cleaned therewith. Such compositions tend to leave behind a hydrophilic residue, which contributes to the water-sheeting effect and helps to remove soil from the glass surface. However, hydrophilic residues do not help with the removal of stains imparted by markers and do not assist in the removal of oily residues.

Compositions that include silanes have been used to impart a hydrophilic property to a glass surface that has been cleaned and activated. The preference for some of these compositions is for the surface be activated immediately prior to, or simultaneously with, the application of the aqueous composition.

Coating compositions that include silanes have also been used to coat glass substrates to render them capable of being easily cleaned.

SUMMARY

In one aspect, the invention features a method of removing an unwanted constituent from a siliceous surface, the method including contacting the siliceous surface and the unwanted constituent with a multi-functional solution that includes water, a hydrophilic silane, and a surfactant, and drying the surface. In one embodiment, the method further includes rubbing the solution on the surface.

In one embodiment, the solution imparts a hydrophilic property to the surface and the dried surface exhibits a greater hydrophilicity relative to the hydrophilicity of the surface prior to the contacting.

In one embodiment, the siliceous surface is a surface of a board selected from the group consisting of a white board and a dry erase board, and the unwanted constituent includes a mark from a marker. In some embodiments, the siliceous surface is a surface of a window and the unwanted constituent includes at least one of oil and dirt.

In some embodiments, the dried surface exhibits sufficient hydrophilicity such that at least 50% of a mark placed on the surface with a permanent marker is wiped away from the surface within 50 wipes with a damp towel. In other embodiments, the dried surface exhibits sufficient hydrophilicity such that at least 50% of a mark placed on the surface with a permanent marker is washed away from the surface within 2 minutes by a spray of water applied at a rate of 600 milliliters per minute. In some embodiments, the dried surface exhibits sufficient hydrophilicity such that a fingerprint of artificial sebum placed on the dried surface is washed away from the surface within 2 minutes by a spray of water applied at a rate of 600 milliliters per minute. In other embodiments, when the dried surface is contacted with moisture vapor, no condensation occurs.

In other aspects, the invention features a method of removing an unwanted constituent from a siliceous surface, the method including contacting the siliceous surface and the unwanted constituent with a multi-functional composition that includes water, a hydrophilic silane, surfactant, and at least one of water soluble alkali metal silicate, tetraalkoxysilane, tetraalkoxysilane oligomer, and an inorganic silica sol, and drying the surface.

In some aspects, the invention features a method of determining the cleanliness of a previously cleaned substrate, the method including exposing the previously cleaned surface, which is at a temperature of from 0° C. to about 25° C., to moisture vapor, observing whether or not condensation occurs, and if fogging is present, determining that the surface is dirty, and if fogging does not occur or is not present more than 30 seconds after exposure to the moisture vapor, determining that the surface is clean.

In another aspect, the invention features a method of determining the cleanliness of a previously cleaned substrate, the method including placing a mark with a permanent marker on the previously cleaned surface of the substrate, saturating the mark with water, wiping the mark with a paper towel, and determining whether or not at least 90% of the mark has been washed away by the spray of water, and if at least 90% of the mark has been washed away by the spray of water, then determining that the surface is clean. In some embodiments, the method further includes determining that the surface is not clean if at least 50% of the mark has not been washed away by the spray of water.

In other aspects, the invention features a method of determining the cleanliness of a previously cleaned substrate, the method including placing a fingerprint of artificial sebum on the previously cleaned surface of the substrate, spraying the fingerprint and the substrate with a stream of deionized water at a flow rate of no greater than 600 milliliters per min for no greater than 30 seconds, and determining whether or not at least 50% of the fingerprint has been washed away by the spray of water, if at least 50% of the fingerprint has been washed away by the spray of water, then determining that the surface is clean, and if at least 50% of the fingerprint has not been washed away by the spray of water, then determining that the surface is not clean.

In other aspects the invention features a multi-functional solution that includes a first hydrophilic silane, surfactant, the ratio of the weight of the hydrophilic silane to the weight of the surfactant being at least 1:1, and water. In one embodiment, the solution further includes at least one of a water soluble alkali metal silicate, a tetraalkoxysilane, and a tetraalkoxysilane oligomer. In some embodiments, the solution further includes a second surfactant different from the first surfactant. In one embodiment, the solution further includes a second hydrophilic silane different from the first hydrophilic silane.

In another embodiment, the solution includes a water soluble alkali metal silicate comprising at least one of lithium silicate, sodium silicate, and potassium silicate.

In some embodiments, the solution passes Permanent Marker Removal Test Method I. In other embodiments, the solution passes Artificial Sebum Removal Test Method I. In some embodiments, the solution passes the Fog Test Method.

In another embodiment, the solution includes from at least 0.01% by weight to no greater than 3% by weight hydrophilic silane. In some embodiments, the solution includes no greater than 0.5% by weight hydrophilic silane. In other embodiments, the solution includes no greater than 2% by weight solids. In one embodiment, the solution includes no greater than 1% by weight solids.

In some embodiments, the solution includes the hydrophilic silane includes a zwitterionic silane. In other embodiments, the solution includes from about 0.01% by weight to about 5% by weight zwitterionic silane. In another embodiment, the solution includes from about 0.1% by weight to about 2% by weight zwitterionic silane.

In some embodiments, the surfactant includes at least one of anionic surfactant, nonionic surfactant, cationic surfactant, amphoteric betaine surfactant, amphoteric sultaine surfactant, amphoteric imidazoline surfactant, amine oxide surfactant, and quaternary cationic surfactant. In other embodiments, the first surfactant includes a nonionic surfactant and the second surfactant includes an anionic surfactant.

In some embodiments, the hydrophilic silane has a molecular weight no greater than 1000 grams per mole. In another embodiment, the hydrophilic silane has a molecular weight no greater than 500 grams per mole.

In one embodiment, the solution includes at least 60% by weight water. In other embodiments, the composition includes no greater than 30% by weight water.

In another aspect, the invention features a liquid multi-functional composition that includes a hydrophilic silane, a first surfactant, at least one of a water soluble alkali metal silicate, a tetraalkoxysilane, a tetraalkoxysilane oligomer, and an inorganic silica sol, and water. In one embodiment, the hydrophilic silane includes a zwitterionic hydrophilic silane. In some embodiments, the hydrophilic silane is selected from the group consisting of zwitterionic silane, hydroxyl sulfonate silane, phosphonate silane, carboxylate silane, glucanamide silane, polyhydroxyl alkyl silane, hydroxyl polyethyleneoxide silanes, polyethyleneoxide silanes, and combinations thereof. In some embodiments, the composition passes Permanent Marker Removal Test Method I. In other embodiments, the composition passes Artificial Sebum Removal Test Method I. In another embodiment, the composition passes the Fog Test Method.

In other embodiments, the composition further includes water insoluble particles. In one embodiment, the composition further includes abrasive particles.

In some embodiments, the composition further includes a second surfactant different from the first surfactant.

In other aspects, the invention features a multi-functional liquid composition that includes a hydrophilic silane, a first surfactant, a second surfactant different from the first surfactant, and water. In one embodiment, the hydrophilic silane is selected from the group consisting of zwitterionic silane, hydroxyl sulfonate silane, phosphonate silane, carboxylate silane, glucanamide silane, polyhydroxyl alkyl silane, hydroxyl polyethyleneoxide silane, polyethyleneoxide silane, and combinations thereof. In another embodiment, the composition passes Permanent Marker Removal Test Method I. In some embodiments, the composition passes Artificial Sebum Removal Test Method I. In other embodiments, the composition passes the Fog Test Method. In some embodiments, the composition further includes water insoluble particles. In one embodiment, the composition further includes abrasive particles. In some embodiments, the composition further includes a second surfactant different from the first surfactant.

In other aspects the invention features a method of using a multi-functional solution, the method includes diluting a concentrated solution with water to form a diluted solution, the concentrated solution comprising a first hydrophilic silane and surfactant where the ratio of the weight of the hydrophilic silane to the weight of the surfactant is at least 1:1, and contacting a silaceous surface with the diluted solution.

GLOSSARY

The term "surfactant" means molecules that include hydrophilic (i.e., polar) and hydrophobic (i.e., non-polar) regions on the same.

The term "hydrophilic surface" means a surface that it is wet by aqueous solutions and on which a drop of water exhibits a static water contact angle of less than 50°. The term hydrophilic surface does not express whether or not the surface absorbs aqueous solutions.

The phrase "hydrophobic surface" means a surface on which a drop of water exhibits a static water contact angle of at least 50°.

The term "aqueous" means water is present.

The term "solution" means a homogeneous composition in which the solute is dissolved in the solvent and cannot be separated from the solvent by filtration or physical means.

The phrase "unwanted constituent" means a surface irregularity, a surface defect, a contaminant, foreign matter, and combinations thereof.

DETAILED DESCRIPTION

The method of removing an unwanted constituent from a siliceous surface of a substrate includes contacting the substrate surface and the unwanted constituent with a multi-functional composition that includes a hydrophilic silane, a surfactant, and water, optionally applying a mechanical action to the composition and the surface, and drying the surface. The mechanical action can be any suitable mechanical action including, e.g., wiping and rubbing, and the drying can occur through any suitable process including, e.g., allowing the surface to air dry, wiping the surface dry, contacting the surface with forced air (e.g., cooled or heated air relative to room temperature), and combinations thereof.

The resulting surface is free of, or substantially free of, the unwanted constituent, and exhibits an improved hydrophilicity relative to the untreated surface and an improved ease of cleaning relative to the untreated surface.

The method of removing can be a method of removing any of a variety of unwanted constituents including, e.g., a method of removing contaminants (i.e., a method of cleaning), a method of removing surface irregularities and defects (i.e., method of finishing), and combinations thereof.

The method can be used to remove a variety of contaminants from a siliceous surface including, e.g., dirt, soap scum, oil (e.g., skin oil and motor oil), wax, food residue (e.g., butter, lard, margarine, meat protein, vegetable protein, calcium carbonate, and calcium oxide), grease, ink (e.g., permanent marker ink, ball point pen ink, and felt tip pen ink), insect residue, alkaline earth metal carbonates, adhesives, soot, clay, pigments, and combinations thereof, a variety of surface irregularities and defects (e.g., pits, nicks, lines, scratches, and combinations thereof), and combinations thereof.

The method is also useful for a variety of specific applications including, e.g., removing a mark made by a marker from a board, removing environmental pollutants (e.g., oil and dirt) from glass (e.g., a window, windshield, eyeglasses, lens (e.g., camera lens, optical lens), and cooktop), and combinations thereof. Marks that can be removed include marks made by permanent markers, non-permanent markers, and combinations thereof. Writing boards that can be cleaned include, e.g., dry-erase boards and white-boards. Dry erase boards and white boards are described in many publications including, e.g., WO 2011/163175 and incorporated herein.

The invention also features methods of determining the cleanliness of a previously cleaned substrate. One useful method includes exposing the previously cleaned surface, which is at a temperature of from 0° C. to about 25° C., to moisture vapor, observing whether or not condensation in the form of small droplets (i.e., fogging) occurs on the surface, and determining that either 1) the surface is dirty, if fogging is present, and 2) the surface is clean, if fogging does not occur or is not present more than 30 seconds minutes after exposure to the moisture vapor.

Another useful method of determining the cleanliness of a previously cleaned substrate includes placing a mark with a permanent marker on the surface, spraying the mark and the substrate with water to saturate the mark, waiting 30 seconds, wiping the mark with a paper towel, determining whether or not at least 50% of the mark has been wiped away, and if at least 50% of the mark has been wiped away, then determining that the surface is clean. Alternatively, the method includes determining that the surface is clean if at least 80% of the mark, at least 75% of the mark or even if at least 70% of the mark has been wiped away. The method optionally further includes determining that the surface is not clean if at least 50% of the mark, at least 60% of the mark, at least 70% of the mark, or even if at least 80% of the mark has not been wiped away.

Another useful method of determining the cleanliness of a previously cleaned substrate includes placing a mark with a permanent marker on the surface, spraying the mark and the substrate with a stream of deionized water at a flow rate of 600 millileters (mL) per minute (min) for 30 seconds, determining whether or not at least 90% of the mark has been washed away by the spray of water, and if at least 90% of the mark has been washed away by the spray of water, then determining that the surface is clean. The method optionally further includes determining that the surface is not clean, if at least 50% of the mark, at least 60% of the mark, at least 70% of the mark, or even if at least 80% of the mark has not been washed away by the spray of water. Alternatively, the method includes determining that the surface is clean if at least 80% of the mark, at least 75% of the mark or even if at least 70% of the mark has been washed away by the spray of water.

Other useful methods of determining the cleanliness of a previously cleaned substrate include placing a fingerprint of artificial sebum on the surface, spraying the fingerprint and the substrate with a stream of deionized water at a flow rate of 600 mL per min for 30 seconds, determining whether or not at least 50% of the fingerprint has been washed away by the spray of water, if at least 50% of the fingerprint has been washed away by the spray of water, then determining that the surface is clean, if at least 50% of the fingerprint has not been washed away by the spray of water, then determining that the surface is not clean. Alternatively, the method includes determining that the surface is clean if at least 80% of the fingerprint, at least 75% of the fingerprint or even if at least 70% of the fingerprint has been washed away by the spray of water. The method optionally further includes determining that the surface is not clean if at least 50% of the fingerprint, at least 60% of the fingerprint, at least 70% of the fingerprint, or even if at least 80% of the fingerprint has not washed away by the spray of water.

The Multi-Functional Composition

The multi-functional composition includes a hydrophilic silane, at least one surfactant, and water. The multi-functional composition exhibits multiple functions in that it removes an unwanted constituent from the substrate surface, imparts a hydrophilic property to the substrate surface, and imparts an easy to clean property to the substrate surface. The multi-functional composition can be any composition useful for removing an unwanted constituent including, e.g., a cleaning composition, a finishing composition (e.g., a polishing composition, a buffing composition, and combinations thereof), and combinations thereof.

The multi-functional composition can be applied to a clean surface, a surface that is soiled, a surface that includes irregularities and defects, a previously cleaned surface, and combinations thereof, and can be used repeatedly. Repeated use of the multi-functional composition on a surface increases the amount of hydrophilic silane on the surface and increases the hydrophilicity of the surface.

The multi-functional composition preferably imparts a sufficient hydrophilic property to a surface such that when the surface is subsequently contaminated with a fingerprint, the fingerprint can be substantially removed, or even completely removed, from the surface with water (e.g., tap water at ambient temperature), water vapor (e.g., from a steamer or an individual's breath), wiping (e.g., up to a few gentle strokes with a tissue, paper towel, cloth), a cleaning composition, and combinations thereof.

The multi-functional composition also preferably imparts a sufficient hydrophilic property to a surface such that when the surface is subsequently marked with a permanent marker, the mark can be substantially removed, or even completely removed, from the surface with at least one of water (e.g., tap water at ambient temperature), water vapor (e.g., an individual's breath), wiping (e.g., up to a few gentle strokes with a tissue, paper towel, cloth), a cleaning composition, and combinations thereof (e.g., by spraying the surface and the mark with water and then wiping). The multi-functional composition preferably imparts a sufficient hydrophilic property to the surface to enable the mark from a permanent marker to slide off the substrate surface when contacted with water, e.g., a stream of water from a water bottle.

The multi-functional composition also preferably imparts an anti-fog property to the surface of the substrate such that the surface does not maintain condensed moisture thereon for an extended period of time, preferably after 30 seconds, and for at least three days, at least 7 days, or even at least 30 days.

The multi-functional composition preferably passes at least one of the Permanent Marker Test Method I, the Fingerprint Test Method I, and the Fog Test Method, after at least one contamination and cleaning cycle, at least two contamination and cleaning cycles, or even after at least three contamination and cleaning cycles.

The multi-functional composition preferably includes an amount of hydrophilic silane and an amount of surfactant such that ratio of the weight of the hydrophilic silane to the weight of the surfactant in the composition is at least 1:1, at least 1:2, at least 1:3, at least 1:10, at least 1:40, at least 1:400, from about 1:2 to about 1:100, or even from about 1:3 to at about 1:20.

The multi-functional composition can be acidic, basic, or neutral. The pH of the composition can be altered to achieve the desired pH using any suitable acid or base including, e.g., organic acids and inorganic acids. Compositions that include sulfonate-functional zwitterionic compounds have a pH of from about 5 to about 8, are neutral, or even are at their isoelectric point.

The multi-functional composition can be provided in a variety of forms including, e.g., as a concentrate that is diluted before use (e.g., with water, a solvent or an aqueous-based composition that includes an organic solvent) or as a ready to use composition, a liquid, a paste, a foam, a foaming liquid, a gel, and a gelling liquid. The multi-functional composition has a viscosity suitable for its intended use or application including, e.g., a viscosity ranging from a water-like thinness to a paste-like heaviness at 22° C. (about 72° F.).

Useful multi-functional compositions include no greater than 2% by weight solids, or even no greater than 1% by weight solids.

Hydrophilic Silane

The hydrophilic silane is a water soluble, nonpolymeric compound. Useful hydrophilic silanes include, e.g., individual molecules, oligomers (e.g., monodisperse oligomers and polydisperse oligomers), and combinations thereof, and preferably have a number average molecular weight no greater than 5000 grams per mole (g/mole), no greater than 3000 g/mole, no greater than 1500 g/mole, no greater than 1000 g/mole or even no greater than 500 g/mole. The hydrophilic silane optionally is a reaction product of at least two hydrophilic silane molecules.

The hydrophilic silane can be any one of a variety of different classes of hydrophilic silanes including, e.g., zwitterionic silanes, non-zwitterionic silanes (e.g., cationic silanes, anionic silanes and nonionic silanes), silanes that include functional groups (e.g., functional groups attached directly to a silicon molecule, functional groups attached to another molecule on the silane compound, and combinations thereof), and combinations thereof. Useful functional groups include, e.g., alkoxysilane groups, siloxy groups (e.g., silanol), hydroxyl groups, sulfonate groups, phosphonate groups, carboxylate groups, gluconamide groups, sugar groups, polyvinyl alcohol groups, quaternary ammonium groups, halogens (e.g., chlorine and bromine), sulfur groups (e.g., mercaptans and xanthates), color-imparting agents (e.g., ultraviolet agents (e.g., diazo groups) and peroxide groups), click reactive groups, bioactive groups (e.g., biotin), and combinations thereof.

Examples of suitable classes of hydrophilic silanes that include functional groups include sulfonate-functional zwitterionic silanes, sulfonate-functional non-zwitterionic silanes (e.g., sulfonated anionic silanes, sulfonated nonionic silanes, and sulfonated cationic silanes), hydroxyl sulfonate silanes, phosphonate silanes (e.g., 3-(trihydroxysilyl)propyl methyl-phosphonate monosodium salt), carboxylate silanes, gluconamide silanes, polyhydroxyl alkyl silanes, polyhydroxyl aryl silanes, hydroxyl polyethyleneoxide silanes, polyethyleneoxide silanes, and combinations thereof.

One class of useful sulfonate-functional zwitterionic silanes has the following Formula (I):

$$(R^1O)p\text{-}Si(R^2)q\text{-}W\text{—}N^+(R^3)(R^4)\text{—}(CH_2)m\text{-}SO_3^- \quad (I)$$

wherein:

each $R^1$ is independently a hydrogen, methyl group, or ethyl group;

each $R^2$ is independently a methyl group or an ethyl group;

each $R^3$ and $R^4$ is independently a saturated or unsaturated, straight chain, branched, or cyclic organic group, which may be joined together, optionally with atoms of the group W, to form a ring;

W is an organic linking group;

p and m are integers of from 1 to 3;

q is 0 or 1; and p+q=3.

The organic linking group W of Formula (II) can be saturated and unsaturated, straight chain, branched, and cyclic organic groups and can include, e.g., alkylenes, alkylenes that include carbonyl groups, urethanes, ureas, organic linking groups substituted with heteroatoms (e.g., oxygen, nitrogen, sulfur, and combinations thereof), and combinations thereof. Suitable alkylenes include, e.g., cycloalkylenes, alkyl-substituted cycloalkylenes, hydroxy-substituted alkylenes, hydroxy-substituted mono-oxa alkylenes, divalent hydrocarbons having mono-oxa backbone substitution, divalent hydrocarbons having mono-thia backbone substitution, divalent hydrocarbons having monooxo-thia backbone substitution, divalent hydrocarbons having dioxo-thia backbone substitution, arylenes, arylalkylenes, alkylarylenes and substituted alkylarylenes.

Suitable examples of the zwitterionic functional group $\text{—}W\text{—}N^+(R^3)(R^4)\text{—}(CH_2)_m\text{—}SO_3^-$ include sulfoalkyl imidazolium salts, sulfoaryl imidazolium salts, sulfoalkyl pyridinium salts, sulfoalkyl ammonium salts (e.g., sulfobetaine), and sulfoalkyl piperidinium salts. Suitable zwitterionic silanes of Formula (I) are also described in U.S. Pat. No. 5,936,703 (Miyazaki et al.) and International Publication Nos. WO 2007/146680 and WO 2009/119690, and incorporated herein.

Another useful class of sulfonate-functional zwitterionic silanes includes sulfonate-functional zwitterionic silanes having the Formula (II):

$$(R^1O)p\text{-}Si(R^2)q\text{-}CH_2CH_2CH_2\text{—}N^+(CH_3)_2\text{—}(CH_2)m\text{-}SO_3^- \quad (II)$$

wherein:

each $R^1$ is independently a hydrogen, methyl group, or ethyl group;

each $R^2$ is independently a methyl group or an ethyl group;

p and m are integers of from 1 to 3;

q is 0 or 1; and p+q=3.

Suitable examples of sulfonate functional zwitterionic silanes of Formula (II) are described in U.S. Pat. No. 5,936,703 (Miyazaki et al.), and incorporated herein, and include, e.g., $(CH_3O)_3Si\text{—}CH_2CH_2CH_2\text{—}N^+(CH_3)_2\text{—}CH_2CH_2CH_2\text{—}SO_3^-$; $(CH_3CH_2O)_2Si(CH_3)\text{—}CH_2CH_2CH_2\text{—}N^+(CH_3)_2\text{—}CH_2CH_2CH_2\text{—}SO_3^-$; and $(OH)_3SiCH_2CH_2CH_2N^+(CH_3)_2CH_2CH_2CH_2SO_3^-$.

Other suitable zwitterionic silanes include, e.g., $(OH)_3SiCH_2CH_2CH_2N^+(CH_3)_2CH_2CH_2CH_2CH_2SO_3^-$; $(OH)_3SiCH_2CH_2CH_2[C_5H_5N^+]CH_2CH_2CH_2SO_3^-$; $(OH)_3SiCH_2CH_2CH_2N^+(CH_3)_2CH_2CH_2(OH)CH_2SO_3^-$; $(CH_3O)_3SiCH_2CH_2CH_2N^+(CH_3CH_2)_2CH_2CH_2CH_2SO_3^-$; $(CH_3O)_3S$ $CH_2CH_2CH_2CH_2CH_2CH_2CH_2N^+(CH_3CH_2)_2CH_2CH_2CH_2SO_3^-$; $(CH_3CH_2O)_3SiCH_2CH_2CH_2NHCH(O)NHCH_2CH_2N^+CH_2CH_2CH_2SO_3^-$; and $(CH_3CH_2O)_3SiCH_2\ CH_2\ CH_2NHC(O)OCH_2CH_2OCH_2CH_2N^+(CH_3)_2CH_2CH_2CH_2SO_3^-$.

Another useful class of sulfonate-functional non-zwitterionic silanes has the following Formula (III):

$$[(MO)(Q_n)Si(XCH_2SO_3^-)_{3-n}]Y_{2/nr}^{+r} \quad \text{(III)}$$

wherein:

each Q is independently selected from hydroxyl, alkyl groups containing from 1 to 4 carbon atoms and alkoxy groups containing from 1 to 4 carbon atoms;

M is selected from hydrogen, alkali metals, and organic cations of strong organic bases having an average molecular weight of less than 150 and a pKa of greater than 11;

X is an organic linking group;

Y is selected from hydrogen, alkaline earth metals, organic cations of protonated weak bases having an average molecular weight of less than 200 and a pKa of less than 11, alkali metals, and organic cations of strong organic bases having an average molecular weight of less than 150 and a pKa of greater than 11, provided that when Y is hydrogen, alkaline earth metals or an organic cation of a protonated weak base, M is hydrogen;

r is equal to the valence of Y; and n is 1 or 2.

Preferred non-zwitterionic silanes of Formula (III) include alkoxysilane compounds in which Q is an alkoxy group containing from 1 to 4 carbon atoms.

The silanes of Formula (III) preferably include is at least 30% by weight, at least 40% by weight, or even from about 45% by weight to about 55% by weight oxygen, and no greater than 15% by weight silicon, based on the weight of the compound in the water-free acid form.

Useful organic linking groups X of Formula (III) include, e.g., alkylenes, cycloalkylenes, alkyl-substituted cycloalkylenes, hydroxy-substituted alkylenes, hydroxy-substituted mono-oxa alkylenes, divalent hydrocarbons having mono-oxa backbone substitution, divalent hydrocarbons having mono-thia backbone substitution, divalent hydrocarbons having monooxo-thia backbone substitution, divalent hydrocarbons having dioxo-thia backbone substitution, arylenes, arylalkylenes, alkylarylenes, and substituted alkylarylens.

Examples of useful Y include 4-aminopyridine, 2-methoxyethylamine, benzylamine, 2,4-dimethylimidazole, and 3-[2-ethoxy(2-ethoxyethoxy)]propylamine, $^+N(CH_3)_4$, and $^+N(CH_2CH_3)_4$.

Suitable sulfonate-functional non-zwitterionic silanes of Formula (I) include, e.g., $(HO)_3Si—CH_2CH_2CH_2—O—CH_2—CH(OH)—CH_2SO_3—H^+$; $(HO)_3Si—CH_2CH(OH)—CH_2SO_3—H^+$; $(HO)_3Si—CH_2CH_2CH_2SO_3—H^+$; $(HO)_3Si—C_6H_4—CH_2CH_2SO_3—H^+$; $(HO)_2Si—[CH_2CH_2SO_3H^+]_2$; $(HO)—Si(CH_3)_2—CH_2CH_2SO_3—H^+$; $(NaO)(HO)_2Si—CH_2CH_2CH_2—O—CH_2—CH(OH)—CH_2SO_3—Na^+$; and $(HO)_3Si—CH_2CH_2SO_3—K^+$ and those sulfonate-functional non-zwitterionic silanes of Formula (I) described in U.S. Pat. No. 4,152,165 (Langager et al.) and U.S. Pat. No. 4,338,377 (Beck et al) and incorporated herein.

The multi-functional composition preferably includes at least 0.005% by weight, at least 0.01% by weight, at least 0.05% by weight, no greater than 3% by weight, no greater than 2% by weight, no greater than 1.5% by weight, no greater than 1% by weight, no greater than 0.75% by weight, or even no greater than 0.5% by weight hydrophilic silane. The hydrophilic silane optionally is provided in a concentrated form that can be diluted to achieve the percent by weight hydrophilic silane set forth above.

Water

The amount of water present in the multi-functional composition varies depending upon the purpose and form of the composition. The multi-functional composition can be provided in a variety of forms including, e.g., as a concentrate that can be used as is, a concentrate that is diluted prior to use, and as a ready to use composition. Useful multi-functional concentrate compositions include at least about 60% by weight, at least about 65% by weight, at least about 70% by weight, no greater than 97% by weight, no greater than 95% by weight, no greater than 90% by weight, from about 75% by weight to about 97% by weight, or even from about 75% by weight to 95% by weight water.

Useful ready to use compositions include at least 70% by weight, at least 80% by weight, at least 90% by weight, at least 95% by weight, from about 80% by weight to 99.75% by weight, or even from about 80% by weight to 97% by weight water.

Surfactant

Suitable surfactants include, e.g., anionic, nonionic, cationic, and amphoteric surfactants, and combinations thereof.

Useful anionic surfactants include surfactants having a molecular structure that includes: (1) at least one hydrophobic moiety (e.g., an alkyl group having from 6 to 20 carbon atoms in a chain, alkylaryl group, alkenyl group, and combinations thereof), (2) at least one anionic group (e.g., sulfate, sulfonate, phosphate, polyoxyethylene sulfate, polyoxyethylene sulfonate, polyoxyethylene phosphate, and combinations thereof), (3) salts of such anionic groups (e.g., alkali metal salts, ammonium salts, tertiary amino salts, and combinations thereof), and combinations thereof.

Useful anionic surfactants include, e.g., fatty acid salts (e.g., sodium stearate and sodium dodecanoate), salts of carboxylates (e.g., alkylcarboxylates (carboxylic acid salts) and polyalkoxycarboxylates, alcohol ethoxylate carboxylates, and nonylphenol ethoxylate carboxylates); salts of sulfonates (e.g., alkylsulfonates (alpha-olefinsulfonate), alkylbenzenesulfonates (e.g., sodium dodecylbenzenesulfonate), alkylarylsulfonates (e.g., sodium alkylarylsulfonate), and sulfonated fatty acid esters); salts of sulfates (e.g., sulfated alcohols (e.g., fatty alcohol sulfates, e.g., sodium lauryl sulfate), salts of sulfated alcohol ethoxylates, salts of sulfated alkylphenols, salts of alkylsulfates (e.g., sodium dodecyl sulfate), sulfosuccinates, and alkylether sulfates), aliphatic soap, fluorosurfactants, anionic silicone surfactants, and combinations thereof.

Suitable commercially available anionic surfactants include sodium lauryl sulfate surfactants available under the trade designations TEXAPON L-100 from Henkel Inc. (Wilmington, Del.) and STEPANOL WA-Extra from Stepan Chemical Co. (Northfield, Ill.), sodium lauryl ether sulfate surfactants available under the POLYSTEP B-12 trade designation from Stepan Chemical Co., ammonium lauryl sulfate surfactants available under the trade designation STANDAPOL A from Henkel Inc., sodium dodecyl benzene sulfonate surfactants available under the trade designation SIPONATE DS-10 from Rhone-Poulenc, Inc. (Cranberry, N.J.), decyl(sulfophenoxy)benzenesulfonic acid disodium salt available under the trade designation DOWFAX C10L from The Dow Chemical Company (Midland, Mich.).

Useful amphoteric surfactants include, e.g., amphoteric betaines (e.g., cocoamidopropyl betaine), amphoteric sultaines (cocoamidopropyl hydroxysultaine and cocoamidopropyl dimethyl sultaine), amphoteric imidazolines, and combinations thereof. A useful cocoamidopropyl dimethyl sultaine is commercially available under the LONZAINE CS trade designation from Lonza Group Ltd. (Basel, Switzerland). Useful coconut-based alkanolamide surfactants are commercially available from Mona Chemicals under the MONAMID 150-ADD trade designation). Other useful commercially available amphoteric surfactants include, e.g., caprylic glycinate (an example of which is available under the REWOTERIC AMV trade designation from Witco Corp.) and capryloamphodipropionate (an example of which is available under the AMPHOTERGE KJ-2 trade designation from Lonza Group Ltd.

Examples of useful nonionic surfactants include polyoxyethylene glycol ethers (e.g., octaethylene glycol monododecyl ether, pentaethylene monododecyl ether, poly-oxyethylenedodecyl ether, polyoxyethylenehexadecyl ether), polyoxyethylene glycol alkylphenol ethers (e.g., polyoxyethylene glycol octylphenol ether and polyoxyethylene glycol nonylphenol ether), polyoxyethylene sorbitan monoleate ether, polyoxyethylenelauryl ether, polyoxypropylene glycol alkyl ethers, glucoside alkyl ethers (e.g., decyl glucoside, lauryl glucoside, and octyl glucoside), glycerol alkyl esters, polyoxyethylene glycol sorbitan alkyl esters, monodecanoyl sucrose, cocamide, dodecylldimethylamine oxide, alkoxylated alcohol nonionic surfactants (e.g., ethoxylated alcohol, propoxylated alcohol, and ethoxylated-propoxylated alcohol). Useful nonionic surfactants include alkoxylated alcohol commercially available under the trade designations NEODOL 23-3 and NEODOL 23-5 from Shell Chemical LP (Houston, Tex.) and the trade designation IGEPAL CO-630 from Rhone-Poulenc, lauramine oxide commercially available under the BARLOX LF trade designation from Lonza Group Ltd. (Basel, Switzerland), and alkyl phenol ethoxylates and ethoxylated vegetable oils commercially available under the trade designation EMULPHOR EL-719 from GAF Corp. (Frankfort, Germany).

Examples of useful cationic surfactants include dodecyl ammonium chloride, dodecyl ammonium bromide, dodecyl trimethyl ammonium bromide, dodecyl pyridinium chloride, dodecyl pyridinium bromide, hexadecyl trimethyl ammonium bromide, cationic quaternary amines, and combinations thereof.

Other useful surfactants are disclosed, e.g., in U.S. Pat. No. 6,040,053 (Scholz et al) and incorporated herein.

The surfactant preferably is present in the composition in an amount sufficient to reduce the surface tension of the composition relative to the composition without the surfactant and to clean the surface. The composition preferably includes at least 0.03% by weight, at least 0.05% by weight, no greater than 0.4% by weight, no greater than 0.25% by weight, from about 0.05% by weight to about 0.2% weight, from about 0.07% by weight to about 0.15% weight, at least 10% by weight surfactant.

Water Soluble Alkali Metal Silicates

The multi-functional composition optionally includes a water soluble alkali metal silicate, a polyalkoxy silane, or a combination thereof. Examples of suitable water soluble alkali metal silicates include lithium silicate, sodium silicate, potassium silicate, alkyl polysilicates and combinations thereof. The water soluble alkali metal silicate, when present in the composition, is preferably present in an amount of at least 0.01% by weight, at least 0.02% by weight, at least 0.05% by weight, at least 0.1% by weight, at least 0.2% by weight, no greater than 10% by weight, no greater than 5% by weight, from about 0.02% by weight to about 1% by weight, at or even from about 0.1% by weight to about 0.5% by weight.

Examples of suitable polyalkoxy silanes include poly (diethoxysiloxane), tetraalkoxysilanes (e.g., tetraethylorthosilicate (TEOS) and oligomers of tetraalkoxysilanes), and combinations thereof. The polyalkoxy silane, when present in the composition, is preferably present in an amount of at least 0.01% by weight, at least 0.02% by weight, at least 0.05% by weight, at least 0.1% by weight, at least 0.2% by weight, no greater than 10% by weight, no greater than 5% by weight, from about 0.02% by weight to about 1% by weight, at or even from about 0.1% by weight to about 0.5% by weight.

Optional Inorganic Colloidal Solution of Inorganic Particles (I.E., a Sol)

The composition optionally includes an inorganic sol, e.g., a silica sol, an alumina sol, a zirconium sol, and combinations thereof. Examples of useful silica sols include aqueous inorganic silica sols and non-aqueous silica sols. A variety of inorganic silica sols in aqueous media are suitable including, e.g., silica sols in water and silica sols in water-alcohol solutions. Useful inorganic sols are commercially available under the trade designations LUDOX from E.I. duPont de Nemours and Co., Inc. (Wilmington, Del.), NYACOL from Nyacol Co. (Ashland, Me.) and NALCO from Ondea Nalco Chemical Co. (Oak Brook, Ill.). One useful silica sol is NALCO 2326 silica sol having a mean particle size of 5 nanometers, pH 10.5, and solid content of 15% by weight. Other useful commercially available silica sols are available under the trade designations NALCO 1115 and NALCO 1130 from Nalco Chemical Co., REMASOL SP30 from Remet Corp., LUDOX SM from E.I. Du Pont de Nemours Co., Inc., and SNOWTEX ST-OUP, SNOWTEX ST-UP, and SNOWTEX ST-PS-S from Nissan Chemical Co.

Useful non-aqueous silica sols (also called silica organosols) include sol dispersions in which the liquid phase is an organic solvent, or an aqueous organic solvent. The particles of the sol are preferably nano-sized particles. Sodium stabilized silica nanoparticles are preferably acidified prior to dilution with an organic solvent such as ethanol. Dilution prior to acidification may yield poor or non-uniform coatings. Ammonium stabilized silica nanoparticles may generally be diluted and acidified in any order.

When present, the composition preferably includes at least 0.005% by weight, at least 0.01% by weight, at least 0.05% by weight, no greater than 3% by weight, no greater than 2% by weight, no greater than 1.5% by weight, or even no greater than 1% by inorganic sol (e.g., inorganic silica sol).

Optional Components

The multi-functional composition optionally includes water insoluble abrasive particles, organic solvents (e.g., water soluble solvents), detergents, chelating agents (e.g., EDTA (ethylene diamine tetra acetate), sodium citrate, and zeolite compounds), fillers, abrasives, thickening agents, builders (e.g., sodium tripolyphosphate, sodium carbonate, sodium silicate, and combinations thereof), sequestrates, bleach (e.g., chlorine, oxygen (i.e., non-chlorine bleach), and combinations thereof), pH modifiers, antioxidants, preservatives, fragrances, dyes, and combinations thereof.

Examples of suitable water insoluble abrasive particles include silica (e.g., silica particles, e.g., silica nanoparticles), perlite, calcium carbonate, calcium oxide, calcium hydroxide, pumice, and combinations thereof. The water insoluble particules, when present in the composition, is preferably present in an amount of from about 0.1% by weight to about 40% by weight, from about 0.1% by weight to about 10% by weight, or even from about 1% by weight to about 5% by weight.

The multi-functional composition optionally includes an organic solvent. When the multi-functional composition is a concentrate, the composition optionally is diluted with an organic solvent or a mixture of organic solvent and water. Useful organic solvents include, e.g., alcohols (e.g., methanol, ethanol, isopropanol, 2-propanol, 1-methoxy-2-propanol, 2-butoxyethanol, and combinations thereof), d-limonene, monoethanolamine, diethylene glycol ethyl ether, tripropylene glycol monomethyl ether, dipropylene glycol n-propyl ether, acetone, and combinations thereof. When present, the composition includes no greater than 50% by weight, from about 0.1% by weight to about 30% by weight, from about 0.2% by weight to about 10% by weight, or even from about 0.5% by weight to about 5% by weight organic solvent.

Thickening agents can help to thicken the composition and may also be utilized where there is a need to increase the time the consumer can wipe the composition before it runs down a vertical surface. Examples of useful thickening agents include polyacrylic acid polymers and copolymers (examples of which are available under the CARBOPOL ETD 2623 trade designation from B. F. Goodrich Corporation (Charlotte, N.C.) and the ACCUSOL 821 trade designation from Rohm and Haas Company (Philadelphia, Pa.), hydroxymethyl cellulose, hydroxyethyl cellulose, hydroxypropyl cellulose, and combinations thereof.

Siliceous Surfaces

The multi-functional composition is useful for removing an unwanted constituent from a variety surfaces including, e.g., glass, ceramic (e.g., porcelain), stone (e.g., granite, and onyx), cement, concrete, surfaces treated with siliceous materials to render them siliceous, and combinations thereof. One method of rendering surfaces siliceous includes vapor deposition of silicon dioxide.

The siliceous surface can be present on substrates made from a variety of materials including, e.g., polymers (e.g., polyester (e.g., polyethylene terephthalate and polybutyleneterephthalate), polycarbonate, allyldiglycolcarbonate, polyacrylate (e.g., polymethylmethacrylate), polystyrene, polysulfone, polyethersulfone, homo-epoxy polymers, epoxy addition polymers with polydiamines, polydithiols, polyolefin (e.g., polyethylene, polypropylene, and copolymers of propylene, ethylene and butene), polyvinyl chloride, and combinations thereof), fluorinated surfaces, cellulose esters (e.g., acetate and butyrate), glass, ceramic, composites (e.g., composites of organic materials, inorganic materials, and combinations thereof (e.g., polymer and cementatious composites that include organic particulate, inorganic particulate, and combinations thereof)), metal (e.g., aluminum, stainless steel, nickel, copper, tin, brass, and combinations thereof), stone (e.g., granite, marble, onyx, soapstone, and limestone), cement, concrete, and combinations thereof. Methods of forming silaceous surfaces on substrates are disclosed in a variety of publications including, e.g., WO 2011163175 and WO 20011084661, both of which are incorporated herein.

The composition is useful on substrates having a variety of forms including, e.g., sheet, panel, pane (e.g., panes used in a variety of applications including, e.g., graphics, signage, and articles including, e.g., computer case, cell phone case, computer screen, phone screen, ophthalmic lenses, architectural glazing, decorative glass frames, motor vehicle windows, windshields, protective eye wear (e.g., surgical masks and face shields) and combinations thereof), solar panels, film (e.g., uniaxially oriented, biaxially oriented, flexible and rigid), appliances (e.g., radios, stereos, ovens, dishwashers, cook tops, stoves, microwaves, refrigerators, freezers, washing machines, and dryers), vehicle surfaces (e.g., body, lights, and windows), flooring (e.g., tile), wall, door, room surfaces (e.g., bathroom and kitchen), e.g., floors, door knobs, toilet bowls, toilet tanks, countertops, mirrors, bath tubs, shower doors, wall surfaces, fixtures (e.g., faucets, handles, spouts, and knobs), towel racks, windows, windshield, mirrors, lenses (e.g., eyeglass, photographic, and optical), vessels (e.g., glasses for drinking, cups, and plates), and combinations thereof.

Article

The composition can be included in any suitable packaging including, e.g., in a vessel equipped with a dispenser (e.g., a plastic bottle equipped with a sprayer or spray pump in a ready to use form), and in a vessel from which the composition can be transferred into another vessel or in which the composition can be diluted, e.g., when the composition is in the form of a concentrate.

Applications

The multi-functional composition or a portion thereof (e.g., the hydrophilic silane alone or in combination with a silicate) can be added to a second composition including, e.g., a cleaning composition (e.g., WINDEX), a finishing composition, and combinations thereof. Alternatively, or in addition, a variety of cleaning and finishing compositions can be formulated to include the composition. The multi-functional composition can be specifically formulated to optimize its ability to clean hard surfaces (e.g., glass, manual and automatic dishwasher surfaces, dishes, glasses, silverware, pots and pans, floors (e.g., tile), and tiled walls), to polish hard surfaces (e.g., floor and appliance polishers), to degrease hard surfaces (e.g., floors, cooking grills, cook tops, ovens, automotive engines, pots, and pans), and combinations thereof.

One useful glass cleaner composition includes from 20% by weight to 99% by weight distilled water, from 0.01% by weight to 2% by weight multi-functional composition, from 0.05% by weight to 0.30% by weight sodium lauryl sulfate, from 0.2% by weight to 7% by weight isopropanol, from 0.01% by weight to 0.20% by weight ethoxylated alcohol, from 0.02% by weight to 0.2% by weight potassium carbonate, from 0.01% by weight to 0.25% by weight glycerin, from 0.0001% by weight to 0.05% by weight fragrance, and about 0.01% by weight color agent.

One useful floor cleaning/polishing concentrate composition includes from 1% by weight to 90% by weight distilled water, from 5% by weight to 30% by weight surfactant, from 1% by weight to 20% by weight wax, and from 0.01% by weight to 10% by weight multifunctional composition. The floor cleaning composition optionally includes an alkali soluble resin, solvent (e.g. glycol ether), and combinations thereof.

One useful tile cleaner composition includes from 0% by weight to 10% by weight anionic detergent, from 0.01% by weight to 10% by weight multifunctional composition, from 0% by weight to 10% by weight propylene glycol butyl ether, from 0% by weight to 10% by weight alcohol ethoxylate, from 0% by weight to 5% by weight $C_{10-16}$-alkyl glycosides builder, and from 0% by weight to 5% by weight antimicrobial preservative, the balance being water.

One useful toilet bowl cleaner composition includes from 0.01% by weight to 10% by weight multifunctional composition, from 0.1% by weight to 1% by weight sodium hydroxide, from 0% by weight to 5% by weight amine oxide surfactant, and from 0% by weight to 5% by weight sodium hypochlorite, from 0.1% by weight to 5% by weight alcohol ethoxylate (e.g. TOMADOL 91-6), with the balance being water. Useful toilet bowl cleaner compositions may be acidic, or even have a pH less than 4.5 and optionally include lactic acid.

One useful soap scum remover includes from 0.05% by weight to 10% by weight surfactant, from 0% by weight to 10% by weight diethylene glycol monoethyl ether, from 0% by weight to 10% by weight chelating agent (e.g. EDTA from 1% by weight to 10% by weight tetrapotassium salt), from 0.1% by weight to 2% by weight organic acid (e.g., lactic or malic acid), and from 0.01% by weight to 10% by weight multifunctional composition, One useful degreaser includes from 0% by weight to 10% by weight diethylene glycol monobutyl ether, from 0% by weight to 10% by weight monoethanolamine (MEA), from 0.1% by weight to 1% by weight carbonate salt (e.g., potassium carbonate), from 0.01% by weight to 10% by weight multifunctional composition, from 0% by weight to 25% by weight chelating agent (e.g., disodium citrate), from 1% by weight to 10% by weight anionic surfactant (e.g., sodium cumene sulfonate), from 0.2% by weight to 29% by weight sodium salt of a ($C_{10-16}$) alkyl benzene sulfonic acid, and from 0% by weight to 10% by weight nonionic surfactant, with water being the balance.

The invention will now be described by way of the following examples. All parts, percentages, and ratios in the examples are by weight unless otherwise noted.

EXAMPLES

Fingerprint Removal Test Method I

Spangler's synthetic sebum prepared according to CSPA Designation DCC-09, May 1983, (Re-approved in 2003) (hereinafter referred to as Artificial Sebum) is applied to the surface of a soda lime glass plate. The sample is allowed to stand for less than 5 minutes at room temperature. The surface of the sample is then rinsed under a stream of deionized water at a flow rate of 600 millileters (mL) per minute (min) for 30 seconds and then the surface is dried with compressed air. The samples are then visually inspected and rated as pass or fail. A rating of "Pass" means at least 50% of the fingerprint is removed, and a rating of "Fail" means the fingerprint remained visible on the sample surface.

Fingerprint Removal Test Method II

A facial oil fingerprint is applied to a substrate surface using facial oil from a person's forehead or nose. The sample is allowed to stand for less than 5 minutes at room temperature. The surface of the sample is then rinsed under a stream of deionized water at a flow rate of 600 millileters (mL) per minute (min) for 30 seconds and then the surface is dried with compressed air. The samples are then visually inspected and rated as pass or fail. A rating of "Pass" means the fingerprint is mostly removed, and a rating of "Fail" means the fingerprint remained visible on the sample surface.

Permanent Marker Removal Test Method I

A series of six permanent markers are applied to the surface of a soda lime glass plate. The test markers include a red AVERY MARKS-A-LOT permanent marker (Avery, Brea, Calif.), a black AVERY MARKS-A-LOT permanent marker, a blue BIC permanent marker (Bic Corporation, Shelton, Conn.), a black BIC, a red SHARPIE permanent marker (Bic Corporation), and a black SHARPIE permanent marker. The name of the marker is written on the cleaned surfaces 5; for example the word "Avery" is written in an area of approximately 7.6 cm×10.2 cm for the Avery markers. The samples are allowed to stand for a period of 30 minutes at room temperature. The surface of each sample is then rinsed under a stream of deionized water at a flow rate of 600 millileters (mL) per minute (min) for 30 seconds and then the surface is dried with compressed air. The samples are visually inspected and the total remaining marking is recorded as a percentage of the original marking. A rating of "Pass" means at least 50% of the mark has been removed from the sample surface, and a rating of "Fail" means less than 50% of the mark has been removed from the sample surface.

Permanent Marker Removal Test Method II

A series of six permanent markers are applied to a glass substrate. The test markers include a red AVERY MARKS-A-LOT permanent marker, a black AVERY MARKS-A-LOT permanent marker, a blue BIC permanent marker, a black BIC permanent marker, a red SHARPIE permanent marker, and a black SHARPIE permanent marker. The name of the marker is written on the cleaned surfaces 5; for example the word "Avery" is written in an area of approximately 7.6 cm×10.2 cm for the Avery markers. The samples are allowed to stand for a period of 30 minutes at room temperature before cleaning them with the test composition and wiping them with a KIMBERLY-CLARK L-30 WYPALL towel (Kimberly Clark, Roswell, Ga.). The samples are visually inspected and the total remaining marking is recorded as a percentage of the original marking.

Permanent Marker Removal Test Method III

A red MARKS-A-LOT permanent marker (Avery, Brea, Calif.) is applied to the sample surface by writing the word "Avery" in an area of approximately 7.6 cm×10.2 cm. The samples are allowed to stand for a period of greater than 10 minutes at room temperature. The samples are then sprayed with deionized water from a spray bottle and wiped with a KIMBERLY-CLARK L-30 WYPALL towel (Kimberly Clark). The samples are visually inspected and the total remaining marking is recorded as a percentage of the original marking.

Fog Test Method

Samples are prepared by spraying 12.7 cm by 17.8 cm float glass panes with Comparative Sample 1 and wiping them clean using a KIMBERLY-CLARK L-30 WYPALL towel (Kimberly Clark). After the panes are dry they are subsequently sprayed with the composition to be tested and then wiped with a L-30 WYPALL towel.

The samples area then held at room temperature for 30 minutes before placing the samples in a 50° F. refrigerator. After the samples have been in the refrigerator for 30 minutes, they are removed and allowed to warm to room temperature with relative humidity (i.e., 72° F. and 80% relative humidity).

After ten seconds the samples are visually observed and rated as pass or fail. A pass rating means that a reflected image can easily be seen in the mirror. A fail rating means that the reflected image was not visible.

Haze Test Method

Haze is measured according to ASTM D1003-00 using a Haze-gard plus hazemeter (Cat. No. 4725 from BYK-Gardner USA (Columbia, Md.)). Sample specimens 15 cm by 15 cm in size are selected such that no oil, dirt, dust or fingerprints are present in the section to be measured. The specimens are then mounted by hand across the haze port of the hazemeter and the measurement activated. Five replicate haze measurements are obtained and the average of the five measurements is reported as the percent (%) haze value.

Contact Angle Test Method

A sample is placed on the viewing stage of a goniometer (NRI C. A. Goniometer, Model 100-00-US made by Rame-Hart Inc, Mountain Lake, N.J.). A minimum volume drop of reagent grade hexadecane is allowed to fall from a 5 ml micrometer syringe, equipped with an 18 gage hypodermic needle at a height of about ¼" (6 mm) onto the specimen. The goniometer viewing light is turned on and the drop is brought into focus. The viewing stage is adjusted to align the zero degree reference line with the bottom of the drop. The movable protractor line is rotated until it is superimposed with the contact angle of the drop. The contact angle is read from the scale. An angle of 0 degrees means complete wetting, and increasing angles mean a more oil repellent (surface energies less than hexadecane surface energy) surface.

Preparation of Cleaning Compositions

Comparative Composition 1

A solution was prepared by combining, with mixing, 74.39% by weight DI water, 4% by weight STEPANOL WA-EXTRA PCK sodium lauryl sulfate (Stepan, Northfield, Ill.), 5% by weight isopropanol, 15% by weight GLUCOPON 425N decyl glucoside surfactant (BASF Corporation, Germany), 1% by weight potassium carbonate, 0.5% by weight chemically pure glycerin, 0.1% by weight applie fragrance, and 0.01% by weight FD&C dye No. 1. The solution was then diluted with water to a ratio of 1:60.

Comparative Composition 2

A solution was prepared by combining, with mixing, 68.7% by weight DI water, 4% by weight STEPANOL WA-EXTRA PCK, 5% by weight isopropanol, 15% by weight GLUCON 425N, 0.5% by weight CP glycerin, 6% by weight TOMADOL 91-6 ethoxylated alcohol surfactant (Air Products and Chemicals, Inc., Allentown, Pa.), 0.8% by weight apple fragrance, and 0.01% by weight LIGUITINT BLUE HP colorant (Milliken and Company, Spartanburg, S.C.). The solution was then diluted with water to a ratio of 1:60.

Hydrophilic Silane Solution 1

Hydrophilic Silane Solution 1 was prepared by combining 49.7 g of a 239 mmol solution of 3-(N,N-dimethylaminopropyl)trimethoxysilane, 82.2 g of deionized (DI) water, and 32.6 g of a 239 mmol solution of 1,4-butane sultone in a screw-top jar. The mixture was heated to 75° C., mixed, and allowed to react for 14 hours.

Example 1

The composition of Example 1 was prepared by combining Hydrophilic Silane Solution 1 with 22% by weight solids LSS-75 lithium silicate solution (Nissan Chemical Company (Houston, Tex.)), in a 50:50 weight to weight (w/w) ratio and then diluting the composition to a 1% by weight solution with the solution of Comparative Composition 1.

Example 2

The composition of Example 2 was prepared by combining Hydrophilic Silane Solution 1 and LSS-75 in a 50:50 weight to weight (w/w) ratio and then diluting the composition to a 0.5% by weight solution with the solution of Comparative Composition 1.

Example 3

The composition of Example 3 was prepared by combining Hydrophilic Silane Solution 1 and LSS-75 in a 50:50 weight to weight (w/w) ratio and then diluting the composition to a 0.1% by weight solution with the solution of Comparative Composition 1.

Example 4

The composition of Example 4 was prepared by combining Hydrophilic Silane Solution 1 and LSS-75 in a 50:50 weight to weight (w/w) ratio and then diluting the composition to a 0.05% by weight solution with the solution of Comparative Composition 1.

Example 5

The composition of Example 5 was prepared by combining Hydrophilic Silane Solution 1 and LSS-75 in a 50:50 weight to weight (w/w) ratio and then diluting the composition to a 0.2% by weight solution with the solution of Comparative Composition 1.

Example 6

The composition of Example 6 was prepared by combining Hydrophilic Silane Solution 1 and LSS-75 in a 50:50 weight to weight (w/w) ratio and then diluting the composition to a 0.05% by weight solution with the solution of Comparative Composition 2.

Examples 7-10 and Comparative A

Float glass panes 12.7 cm by 17.8 cm were sprayed with Comparative Composition 1 and wiped clean using a KIMBERLY-CLARK L-30 WYPALL towel (Kimberly Clark). After the panes had dried they were subsequently sprayed with the compositions of Examples 1-4 and then wiped with a L-30 WYPALL towel. The samples were held at room temperature for 30 minutes before subjecting them to the Fingerprint Removal Test Method II.

If the fingerprint was not removed no further testing was done for that sample. If the fingerprint was successfully removed, the sample was subjected to the test again (i.e., another cycle) until the sample failed. The results are reported in Table 1 below.

TABLE 1

| Example | Sample Composition | Cycle 1 | Cycle 2 | Cycle 3 | Cycle 4 | Cycle 5 |
|---|---|---|---|---|---|---|
| Comparative A | Comparative 1 | Fail | n/a | n/a | n/a | n/a |
| Example 7 | Example 1 | Pass | Pass | Pass | Pass | Fail |
| Example 8 | Example 2 | Pass | Pass | Pass | Pass | Fail |
| Example 9 | Example 3 | Pass | Fail | n/a | n/a | n/a |
| Example 10 | Example 4 | Pass | Fail | n/a | n/a | n/a |

n/a means not applicable because the Example failed before the cycle.

Examples 11-13 and Comparative B

Float glass panes 12.7 cm by 17.8 cm were sprayed with the Comparative Composition 1 and wiped clean using a L-30 WYPALL towel. After the panes had dried they were subsequently sprayed with the composition of Example 4, wiped with a L-30 WYPALL towel, and allowed to dry for 30 minutes at room temperature. This process represented one cleaning cycle. The samples were treated for the number of cleaning cycles noted in Table 2 below.

The samples were then subjected to Fingerprint Removal Test Method II. If the fingerprint was not removed, no further testing was done for that sample. If the fingerprint was successfully removed from a sample, the sample was subjected to the test again until the sample failed. The testing was stopped after ten successful pass cycles. The results are reported in Table 2 below.

TABLE 2

| Example | Cleaning Soln | Cleaning Cycles | Fingerprint Removal Cycles |
|---|---|---|---|
| Comparative B | Comparative 1 | 1 | 0 |
| 11 | Example 4 | 1 | 2 |
| 12 | Example 4 | 5 | >10 |
| 13 | Example 4 | 10 | >10 |

Examples 14 and 15 and Comparative C

Cabinet doors having a 46 cm by 61 cm glass plate (Hamilton Industries, Two Rivers, Wis.) were sprayed with Comparative Composition 1 and wiped clean using a L-30 WYPALL towel. After the panes had dried they were subsequently sprayed with the compositions of Examples 1 and 3 and Comparative Composition 1 and wiped with a L-30 WYPALL towel.

The samples were held at room temperature for 30 minutes and then subjected to Permanent Marker Removal Test Method II. After the completion of the test, the samples were cleaned with isopropanol and wiped with a L-30 WYPALL towel. This constituted one cleaning cycle. The samples were subsequently subjected to three additional cleaning cycles. The results are reported in Table 3 below.

TABLE 3

| Example | Composition | Percent Marker Remaining (Test 1) | Percent Marker Remaining (Test 2) | Percent Marker Remaining (Test 3) |
|---|---|---|---|---|
| Comparative C | Comparative 1 | 90 | 90 | 90 |
| Example 14 | Example 1 | 0 | 0 | 0 |
| Example 15 | Example 3 | 50 | 0 | 0 |

Example 16 and Comparative D

Cabinet doors having a 46 cm by 61 cm glass plate (Hamilton Industries) were sprayed with the composition of Comparative Composition 1 and wiped clean using an L-30 WYPALL towel. After the panes had dried they were sprayed with the composition of Example 1 and Comparative Composition 1 and wiped with an L-30 WYPALL towel.

The samples were held at room temperature for 24 hours and then subjected to Permanent Marker Removal Test Method III. If the permanent marker was not removed no further testing was done for that sample. If the permanent marker was successfully removed, the sample was subjected to the test again. After a sample had successfully passed 20 cycles, the testing was stopped. The results are reported in Table 4 below.

TABLE 4

| Example | Cleaning Soln | Initial | 5 Cycles | 10 Cycles | 15 Cycles | 20 Cycles |
|---|---|---|---|---|---|---|
| Comparative D | Comparative 1 | Fail | — | — | — | — |
| 16 | Example 1 | Pass | Pass | Pass | Pass | Pass |

Example 17 and Comparative E

Mirror glass panes, 10.2 cm by 15.2 cm, were divided into two portions by a piece of masking tape. One half was sprayed with the composition of Example 6 and wiped clean using an L-30 WYPALL towel. The second half was sprayed with the Comparative Composition 2 and wiped clean using an L-30 WYPALL towel.

The samples were held at room temperature for 30 minutes before coating the entire sample with interior soil which was prepared and coated according to CSPA DCC-9 May 1983 (re-approved in 2003) (2 mil thick artificial sebum). The samples were then placed in an oven, held at 50° C. for 120 minutes, removed from the oven, and allowed to cool to room temperature. The treated glass pane was then sprayed with the composition of Comparative Composition 2 and the composition was allowed to penetrate for 1 minute before being rinsed off the glass pane with a stream of tap water.

The samples were then visually inspected and rated as pass if at least 80% of the soil was removed under the water washing, and fail if less than 80% of the soil was removed. The results are reported in Table 5 below.

TABLE 5

| Example | Cleaning Solution | Cleaning Performance |
|---|---|---|
| Comparative E | Comparative 2 | fail |
| 17 | Example 6 | pass |

Example 18 and Comparatives F

Mirror glass panes, 10.2 cm by 15.2 cm, were sprayed with Comparative Composition 2 and wiped clean using an L-30 WYPALL towel. After the panes had dried they were subsequently sprayed with Comparative Composition 2 and the composition of Example 6 and then wiped with an L-30 WYPALL towel. The samples were held at room temperature for 30 minutes before placing the samples in a −19° F. refrigerator. After the samples had been in the refrigerator for 30 minutes, they were removed and allowed to warm to room temperature with relative humidity (i.e., 72° F. and 80% relative humidity).

After 10 seconds the samples were then visually inspected and rated for pass or fail. A pass rating meant that an image could easily be seen in the mirror reflection. A fail rating means that the reflected image was not visible. The results are reported in Table 6 below.

TABLE 6

| Example | Cleaning Solution | Anti-fog |
|---|---|---|
| Comparative F | Comparative 2 | fail |
| 18 | Example 6 | pass |

Example 19 and Comparatives G

Mirror glass panes, 10.2 cm by 15.2 cm, were sprayed with Comparative Composition 2 and wiped clean using an L-30 WYPALL towel. After the panes had dried they were subsequently sprayed with Comparative Composition 2 and the composition of Example 6 and wiped with a L-30 WYPALL towel. The samples remained at room temperature for 30 minutes before placing the samples in a refrigerator at −19° F. After the samples were in the refrigerator for 30 minutes, they were removed and allowed to warm to room temperature with relative humidity (i.e., 72° F. and 80% relative humidity).

The samples were rated as pass or fail after 30 seconds. A pass rating indicated that an image could easily be seen in the mirror reflection after 30 seconds. A fail rating meant that the reflected image was not viewable after 30 seconds. The results are reported in Table 7 below.

TABLE 7

| Example | Cleaning Solution | Anti-fog |
|---|---|---|
| Comparative G | Comparative 2 | fail |
| 19 | Example 6 | pass |

Examples 20 and 21 and Comparative H

Three glass panels, 15.2 cm by 22.9 cm, were sprayed with Comparative Composition 1 and wiped clean using a L-30 WYPALL towel. After the panes had dried, one panel, the panel of Example 20, was sprayed with the composition of Example 4 and wiped with an L-30 WYPALL towel. This constituted one spray and wipe cycle. The spray and wipe cycle was repeated four times at intervals of 15 minutes to simulate multiple cleanings.

A second glass panel, the panel of Example 21, was treated with the composition of Example 5 in the same manner as set forth above.

A third glass panel, the panel of Comparative 10 was left untreated.

The glass panels were mounted vertically at an outdoor test facility in Cottage Grove, Minn. for a period of six weeks. After six weeks the samples were evaluated for contact angle, and haze. The data is reported in Table 8 below.

TABLE 8

| Example | Cleaning Solution | Initial Contact Angle (deg) | Contact Angle (deg) | Delta Haze |
|---|---|---|---|---|
| Comparative H | Comparative 1 | 17 | 53 | 1.7 |
| 20 | Example 4 | 12 | 49 | 1.2 |
| 21 | Example 5 | <5 | 33 | 1.0 |

Example 22 and Comparative I

The composition of Example 22 was prepared by combining Hydrophilic Silane Solution 1 and NALCO 1115 silica sol at a weight to weight ratio of 40:60 w/w and then diluting the same to a 0.5% by weight solution with deionized water. The solution was acidified to a pH of between 3 and 4 using 0.1 N hydrochloric acid.

Two mirrored glass surfaces were sprayed with Comparative Composition 1 and wiped clean using a L-30 WYPALL towel. After the surfaces had dried they were sprayed with the composition of Example 22 and Comparative Composition 1, respectively, and then wiped with a L-30 WYPALL towel. The spray and wipe cycle was repeated three times. The samples were then subjected to Fingerprint Removal Test Method II with the exception that the samples were rinsed with a stream of deionized water for a period of 15 seconds instead of 30 seconds. The results are reported in Table 9 below.

TABLE 9

| Example | Cleaning Solution | Fingerprint Removal Test |
|---|---|---|
| Comparative I | Comparative Composition 1 | Fail |
| 22 | Example 22 | Pass |

Example 23 and Comparative J

The composition of Example 23 is prepared by combining Hydrophilic Silane Solution 1 and tetraethoxysilane in a 50:50 weight to weight (w/w) ratio and then diluting the composition to a 0.1% by weight solution with the solution of Comparative Composition 1.

Two mirrored glass surfaces are sprayed with Comparative Composition 1 and wiped clean using a L-30 WYPALL towel. After the surfaces have dried they are sprayed with the composition of Example 23 and Comparative Composition 1, respectively, and then wiped with a L-30 WYPALL towel. The spray and wipe cycles are repeated three times. The samples are then subjected to Fingerprint Removal Test Method I. The expected results are reported in Table 10 below.

TABLE 10

| Example | Cleaning Solution | Fingerprint Removal Test |
|---|---|---|
| Comparative J | Comparative Composition 1 | Fail |
| 23 | Example 23 | Pass |

Example 24 and Comparative K

The composition of Example 24 was prepared by combining Hydrophilic Silane Solution 1 and NALCO 1115 silica sol in a weight to weight ratio of 50:50 and then diluting the composition to a 0.5% by weight solution with the solution of Comparative Composition 1. The solution was acidified to a pH of 5.5 using 0.1N Hydrochloric Acid.

Two mirrored glass surfaces are sprayed with Comparative Composition 1 and wiped clean using a L-30 WYPALL towel. After the surfaces had dried they were sprayed with the composition of Example 24 and Comparative Composition 1, respectively, and then wiped with a L-30 WYPALL towel. The spray and wipe cycles were repeated ten times. The samples were then subjected to Fingerprint Removal Test Method II with the exception that the samplers were rinsed with a stream of deioinized water for a period of 15 seconds instead of 30 seconds. The results are reported in Table 11 below.

TABLE 11

| Example | Cleaning Solution | Fingerprint Removal Test |
|---|---|---|
| Comparative K | Comparative Composition 1 | Fail |
| 24 | Example 24 | Pass |

Other embodiments are within the claims. In one embodiment, for example,

What is claimed is:

1. A multi-functional solution comprising:

a first hydrophilic zwitterionic silane;

a first surfactant;

the ratio of the weight of the first hydrophilic zwitterionic silane to the weight of the first surfactant being at least 1:1, such that the amount of the first surfactant is equal to or greater than the amount of the first hydrophilic zwitterionic silane; and water.

2. The multi-functional solution of claim 1 further comprising at least one of a water soluble alkali metal silicate, a polyalkoxysilane, and a tetraalkoxysilane oligomer.

3. The multi-functional solution of claim 1 further comprising a second surfactant different from the first surfactant.

4. The multi-functional solution of claim 1 further comprising a second hydrophilic silane different from the first hydrophilic zwitterionic silane.

5. The multi-functional composition of claim 1, wherein the solution imparts greater hydrophilicity to a siliceous surface after being applied to the surface and dried compared to the surface before the solution is applied.

6. The multi-functional solution of claim 1, wherein after the solution is applied to a siliceous surface and dried, the dried surface exhibits sufficient hydrophilicity such that a fingerprint of artificial sebum placed on the dried surface is washed away from the surface within 2 minutes by a spray of water applied at a rate of 600 milliliters per minute.

7. The multi-functional solution of claim 1, wherein after the solution is applied to a siliceous surface and dried, when the dried surface is contacted with moisture vapor, no condensation occurs.

8. The multi-functional solution of claim 1, wherein the hydrophilic zwitterionic silane comprises a sulfonate-functional zwitterionic silane having the following formula (I) or formula (II):

$$(R^1O)p\text{-}Si(R^2)q\text{-}W—N^+(R^3)(R^4)—(CH_2)_m—SO_3^- \quad (I)$$

or $$(R^1O)p\text{-}Si(R^2)q\text{-}CH_2CH_2CH_2—N^-(CH_3)_2—(CH_2)_m—SO_3^- \quad (II)$$

wherein:

each $R^1$ is independently a hydrogen, methyl group, or ethyl group;

each $R^2$ is independently a methyl group or an ethyl group;

each $R^3$ and $R^4$ is independently a saturated or unsaturated, straight chain, branched, or cyclic organic group, which may be joined together, optionally with atoms of the group W, to form a ring;

W is an organic linking group;

p is an integer of from 1 to 3;

m is an integer of from 1 to 4;

q is 0 or 1; and p+q=3.

9. The multi-functional solution of claim 1, wherein the first surfactant comprises a nonionic surfactant and the second surfactant comprises an anionic surfactant.

10. A multi-functional liquid composition comprising:

a hydrophilic silane;

a first surfactant;

a second surfactant different from the first surfactant;

lithium silicate; and water.

11. The multi-functional liquid composition of claim 10, wherein the hydrophilic silane is selected from the group consisting of zwitterionic silane, hydroxyl sulfonate silane, phosphonate silane, carboxylate silane, glucanamide silane, polyhydroxyl alkyl silane, hydroxyl polyethyleneoxide silane, polyethyleneoxide silane, and combinations thereof.

12. The multi-functional liquid composition of claim 10, wherein after the composition is applied to a siliceous surface and dried, the dried surface exhibits sufficient hydrophilicity such that a fingerprint of artificial sebum placed on the dried surface is washed away from the surface within 2 minutes by a spray of water applied at a rate of 600 milliliters per minute.

13. The multi-functional liquid composition of claim 10, wherein after the composition is applied to a siliceous surface and dried, when the dried surface is contacted with moisture vapor, no condensation occurs.

14. The multi-functional composition of claim 10, wherein the hydrophilic silane comprises a sulfonate-functional zwitterionic silane having the following formula (I) or formula (II):

$$(R^1O)p\text{-}Si(R^2)q\text{-}W—N^+(R^3)(R^4)—(CH_2)_m—SO_3^- \quad (I)$$

or $$(R^1O)p\text{-}Si(R^2)q\text{-}CH_2CH_2CH_2—N^-(CH_3)_2—(CH_2)_m—SO_3^- \quad (II)$$

wherein:

each $R^1$ is independently a hydrogen, methyl group, or ethyl group;

each $R^2$ is independently a methyl group or an ethyl group;

each $R^3$ and $R^4$ is independently a saturated or unsaturated, straight chain, branched, or cyclic organic group, which may be joined together, optionally with atoms of the group W, to form a ring;

W is an organic linking group;

p is an integer of from 1 to 3;

m is an integer of from 1 to 4;

q is 0 or 1; and p+q=3.

* * * * *